US009540814B2

(12) United States Patent
Meyer et al.

(10) Patent No.: US 9,540,814 B2
(45) Date of Patent: Jan. 10, 2017

(54) FOUNDATION COLUMN

(71) Applicant: PERMA-COLUMN, INC., Ossian, IN (US)

(72) Inventors: Brandon R. Meyer, Ossian, IN (US); Robert L. Meyer, Bluffton, IN (US); Phillip T. Stoller, Bluffton, IN (US)

(73) Assignee: PERMA-COLUMN, INC, Ossian, IN (US)

( * ) Notice: Subject to any disclaimer, the term of this patent is extended or adjusted under 35 U.S.C. 154(b) by 53 days.

(21) Appl. No.: 13/841,816

(22) Filed: Mar. 15, 2013

(65) Prior Publication Data

US 2013/0326968 A1 Dec. 12, 2013

Related U.S. Application Data

(60) Provisional application No. 61/657,429, filed on Jun. 8, 2012.

(51) Int. Cl.
*E04H 12/22* (2006.01)
*E04C 3/36* (2006.01)

(52) U.S. Cl.
CPC ..... *E04C 3/36* (2013.01); *E04H 12/2253* (2013.01)

(58) Field of Classification Search
CPC ..... E04H 12/2276; E04H 12/2253; E04H 12/2261; E02D 27/16; E02D 27/42; E04B 1/185; E04B 2001/268; E04B 2001/2684; E04B 2001/2692; E04B 2001/2463
See application file for complete search history.

(56) References Cited

U.S. PATENT DOCUMENTS

| | | | | | |
|---|---|---|---|---|---|
| 887,217 | A | * | 5/1908 | Oliphant | 52/295 |
| 1,292,012 | A | | 1/1919 | Morris | |
| 1,606,697 | A | * | 11/1926 | Dean | 52/295 |
| 3,355,852 | A | | 12/1967 | Lally | |
| 4,047,356 | A | | 9/1977 | DePirro | |
| 4,272,929 | A | | 6/1981 | Hanson | |
| 4,329,826 | A | * | 5/1982 | Flogaus et al. | 52/712 |
| 4,386,762 | A | * | 6/1983 | Collins | 256/59 |

(Continued)

FOREIGN PATENT DOCUMENTS

| | | | |
|---|---|---|---|
| EP | 0466292 | * | 1/1992 |
| GB | 2422854 A | * | 8/2006 |

OTHER PUBLICATIONS

Paper submitted by Aaron Fluoro et al., Biological Systems Engineering Department, University of Wisconsin-Madison; May 2006 Moment Resisting Wood Post-To-Concrete Pier Connection.
Catalog Home Projects Connectors, Simpson Strong-Tie Co., Inc., Catalog C-DIY05, "Build a Beautiful Deck", Dec. 2005.

(Continued)

*Primary Examiner* — Christine T Cajilig
(74) *Attorney, Agent, or Firm* — Faegre Baker Daniels LLP

(57) ABSTRACT

A precast concrete column supports a building. In one exemplary embodiment, the precast concrete column includes a connector for securing a wooden column to the precast concrete column such that no portion of the connector extends beyond the cross-section of the wooden column. In an alternative embodiment, a jack screw extends from the distal end of the precast concrete column to provide height adjustment for the precast concrete column. In certain embodiments, an insert or tube is cast into the precast concrete column body to allow a fastener to traverse the precast concrete column body so that structural components of the building may be secured thereto.

25 Claims, 10 Drawing Sheets

(56) References Cited

U.S. PATENT DOCUMENTS

| | | | | |
|---|---|---|---|---|
| 4,432,184 | A * | 2/1984 | Holdschlag | 52/841 |
| 4,924,648 | A * | 5/1990 | Gilb et al. | 52/295 |
| 5,212,918 | A * | 5/1993 | Newhouse et al. | 52/126.3 |
| 5,342,138 | A * | 8/1994 | Saito et al. | 403/189 |
| 5,487,241 | A * | 1/1996 | Gorrell et al. | 52/79.1 |
| 6,018,917 | A * | 2/2000 | Leek | 52/250 |
| 6,494,005 | B2 | 12/2002 | Zimmerman | |
| 6,964,139 | B2 | 11/2005 | Meyer et al. | |
| 7,275,351 | B2 | 10/2007 | Knepp | |
| 7,343,713 | B2 | 3/2008 | Knepp et al. | |
| 7,574,841 | B2 | 8/2009 | Knepp et al. | |
| 7,980,034 | B2 | 7/2011 | Fehr et al. | |
| 8,231,309 | B2 * | 7/2012 | Jones et al. | 405/229 |
| 8,347,571 | B2 | 1/2013 | Fehr et al. | |
| 8,347,584 | B2 | 1/2013 | Fehr et al. | |
| 8,397,442 | B2 * | 3/2013 | Laurin | 52/126.6 |
| 8,572,905 | B1 * | 11/2013 | Driggers | 52/169.9 |
| 8,826,629 | B1 * | 9/2014 | Brindle | 52/745.17 |
| 2005/0204686 | A1 * | 9/2005 | Meyer et al. | 52/720.1 |
| 2007/0267552 | A1 * | 11/2007 | Meyer | 248/156 |
| 2013/0284995 | A1 * | 10/2013 | Myer et al. | 256/19 |

OTHER PUBLICATIONS

Product Brochure, Lester Building Systems, LLC, "A Tradition of Structural Integrity, Farm & Ranch and Shop Buildings" 2009.

Product Brochure, Wick Building Systems, Inc., "An Investment in Strength".

Product Brochure, Morton Buildings, "Garage/Suburban", Morton Buildings, Inc. 2009.

Product Brochure, Walters Buildings, "Suburban/Residential Storage Buildings".

Product Brochure, Sturdi-Wall, "Post Frame Anchor Brackets", Perma-Column, Inc., Jun. 2011.

Webpage: http://www.telajack.com/TELAJACK/tabid/59/Default.aspx, "Telajack Modular Jack Posts" which, accordingly to Internet Archive Wayback Machine, was available Jul. 17, 2009.

Webpage: http://www.tigerbrandjackpost.com/jack-post-s-series.html, "Super "S" Series Jack Posts", which, accordingly to Internet Archive Wayback Machine, was available May 15, 2012.

Webpage: http://www.advancedbasementsystems.net/foundation-repair/crawlspace-jack-posts.html, "Crawl Space Jacks", accessed Jan. 14, 2013.

Product Brochure via webpage: www.heartlandpermacolumn.com/products/perma-deckpost/, Heartland Perma-Column, Precast Concrete Posts, 2010.

* cited by examiner

FOUNDATION COLUMN

CROSS REFERENCE TO RELATED APPLICATION

This application claims priority under 35 U.S.C. 119(e) of U.S. Provisional Patent Application Ser. No. 61/657,429 filed on Jun. 8, 2012 entitled Precast Concrete Column, the entire disclosure of which is hereby incorporated by reference.

BACKGROUND

1. Technical Field

The present disclosure relates to a foundation column for use in supporting a structure such as a post-frame building.

2. Description of the Related Art

Typical post-frame buildings include a series of wooden columns set into the earth and positioned in a geometric configuration generally corresponding to the desired perimeter of a post-frame building. A distal end of each column is set into the earth, while a proximal end is affixed to a truss. Note that for the purposes of this document, the reference point with respect to the use of the words "distal" and "proximal" is taken as the highest point on the post-frame building in question.

The body of each column is joined to an adjacent column via a number of generally horizontally placed planks. Such a horizontally placed plank positioned adjacent the earth is generally referred to as a skirt board or a splash board, while a horizontal plank joining adjacent columns and positioned a distance from the earth is generally referred to as a girt. After the skirt board and girts are affixed to the columns, a siding member is attached to the skirt board and girts to define an exterior of the post-frame building. Similarly, adjacent trusses are joined together by wooden planks referred to as purlins. Generally, purlins are positioned substantially transverse to the trusses. A roofing member can be affixed to the trusses via the purlin to form an exterior roof of the post-frame building.

Typically, to construct a post-frame building, a series of holes are bored into the earth about the perimeter of the building. The depth of these holes can be, e.g., three to five feet, with adjacent holes being placed on, e.g. four to ten foot centers. After the holes are formed, a concrete pad can be positioned in the distal most (i.e., bottom) portion of the hole. Generally, the concrete pad comprises a precast concrete pad having a generally cylindrical shape. In situ poured concrete pads may also be utilized. After each hole receives a concrete pad, a column is set into each hole and the holes are back-filled with, e.g., gravel to maintain the columns in a vertical orientation. Generally, either solid wood columns or laminated wood columns are utilized in post-frame construction. Laminated columns are typically formed of three or more 2×6-inch boards or 2×8-inch boards positioned side by side to form the column. Both the solid and laminated wood columns which are set into the earth must be treated with a wood preservative to prevent degradation thereof due to, e.g., insect damage, and/or damage from the elements, e.g., moisture. Planting treated wood columns in the ground can, potentially, have an adverse impact on the environment.

Alternatives to wood support columns set into the earth are known from U.S. Pat. No. 6,964,139, filed on Feb. 28, 2002, issued on Nov. 15, 2005 and entitled "PRECAST CONCRETE COLUMN FOR USE IN POST-FRAME CONSTRUCTION", the entire disclosure of which is hereby explicitly incorporated by reference herein. Additional support columns are disclosed in U.S. Pat. No. 7,980,034, filed Mar. 21, 2006, issued Jul. 19, 2012 and entitled "STRUCTURAL COLUMN WITH FOOTING STILT", the entire disclosure of which is hereby explicitly incorporated by reference herein; U.S. Pat. No. 7,574,841, filed Sep. 26, 2007, issued Aug. 18, 2009 and entitled "METHOD OF ERECTING A WALL HAVING A VERTICALLY ADJUSTABLE HINGED SUPPORT COLUMN", the entire disclosure of which is hereby explicitly incorporated by reference herein; U.S. Pat. No. 7,343,713, filed Aug. 13, 2004, issued Mar. 18, 2008 and entitled "HINGED SUPPORT COLUMN", the entire disclosure of which is hereby explicitly incorporated by reference herein; and U.S. Pat. No. 7,275,351, filed Mar. 5, 2004, issued Oct. 2, 2007 and entitled "HINGED SUPPORT COLUMN", the entire disclosure of which is hereby explicitly incorporated by reference herein.

SUMMARY

The present disclosure provides an improved foundation column for use, e.g., in the construction of a building such as a post-frame building. In accordance with the present disclosure, a two piece foundation column can be utilized to support a structure such as a post-frame building. The two piece column of the present disclosure generally comprises a foundation column for placement in the earth, with a proximal end thereof protruding from the earth. The proximal end of the foundation column includes a connector for joining the foundation column to a wooden column comprising the second portion of the two piece column of the present disclosure. In one form of the present disclosure, the foundation column comprises a precast concrete column body with the connector extending from a proximal end thereof. In an exemplary embodiment, the connector includes a plurality of apertures to facilitate affixation of the second portion of the two piece column structure thereto.

In one exemplary embodiment, the foundation column of the present disclosure utilizes at least one (in certain embodiments, two) upstanding arm extending from a concrete column body to serve as a connector, with the upstanding arm having a cross-sectional extent along its length that never extends beyond an envelope defined by the cross-sectional extent of the proximal portion of the precast concrete column body. In exemplary embodiments of the present disclosure, a wooden column includes a machined interior slot sized to receive the upstanding arm. In such a construct, no portion of the upstanding arm(s) will be visible from an exterior of a wooden column thereby secured to the precast concrete column body. Advantageously, this allows a wooden column of equal cross-section to the underlying precast concrete column body to be utilized, without the upstanding arm disrupting the consistency of the exterior profile of the assembled column. In the event that a laminated wooden column is utilized, a tool such as a planer can be utilized to remove a thickness of material from a face of one of the lamella of the column at least equal to the thickness of the upstanding arm (e.g., 3/16 inch), with the cross-sectional area of the removed material having sufficient height and width to accommodate placement of the upstanding arm therein.

Apertures formed through the wooden column and the upstanding arm can be sized to receive lag bolts and/or screws to effect securement of the wooden column to the underlying precast concrete column body. If the column is utilized in the corner of a construction, counterbores may be utilized so that the lag bolt does not extend beyond the exterior of the wooden column and possibly interfere with flush positioning of, e.g., a skirt board against the support column.

In another exemplary embodiment, the foundation column of the present disclosure includes a longitudinally oriented tube cast into the distal end of the precast concrete column body and having internally extending threads extending along at least a portion of the inner wall of the tube for threaded engagement with a jack screw. In one embodiment, a nut is welded to a distal end of the tube, with the threaded interior of the nut forming the threaded portion of the inner wall of the tube. In alternative forms of the present disclosure, the tube itself includes an internal thread along its length. A polygonal plate can be secured to the distal end of the jack screw to provide additional support therefor. With the jack screw engaging the internal threads of the tube, rotation of the foundation column relative to the support plate secured to the opposite end of the jack screw will adjust the height of the proximal end of the foundation column relative to the support plate. Such adjustment can be utilized to account for post holes of inconsistent depth.

In yet another exemplary embodiment, anchor receivers, such as one or more transverse sleeves are cast into the concrete column body at positions suitable for receiving fasteners to secure skirt and/or splash boards to the precast concrete column body. In certain applications, lag bolts or screws will be positioned through the transverse sleeves to secure one leg of an angle bracket to the precast concrete column body, with the other leg of the angle bracket secured to the skirt board. Alternative anchor receivers includes plugs embedded in the concrete column body in various orientations. The anchor receivers of the present disclosure will offer increased pull-out resistance to a screw threaded therein, relative to a screw threaded into the concrete body.

BRIEF DESCRIPTION OF THE DRAWINGS

The above mentioned and other features and advantages of this disclosure, and the manner of attaining them, will become more apparent and the disclosure itself will be better understood by reference to the following description of embodiments of the disclosure taken in conjunction with the accompanying drawings, wherein.

Figure 1:
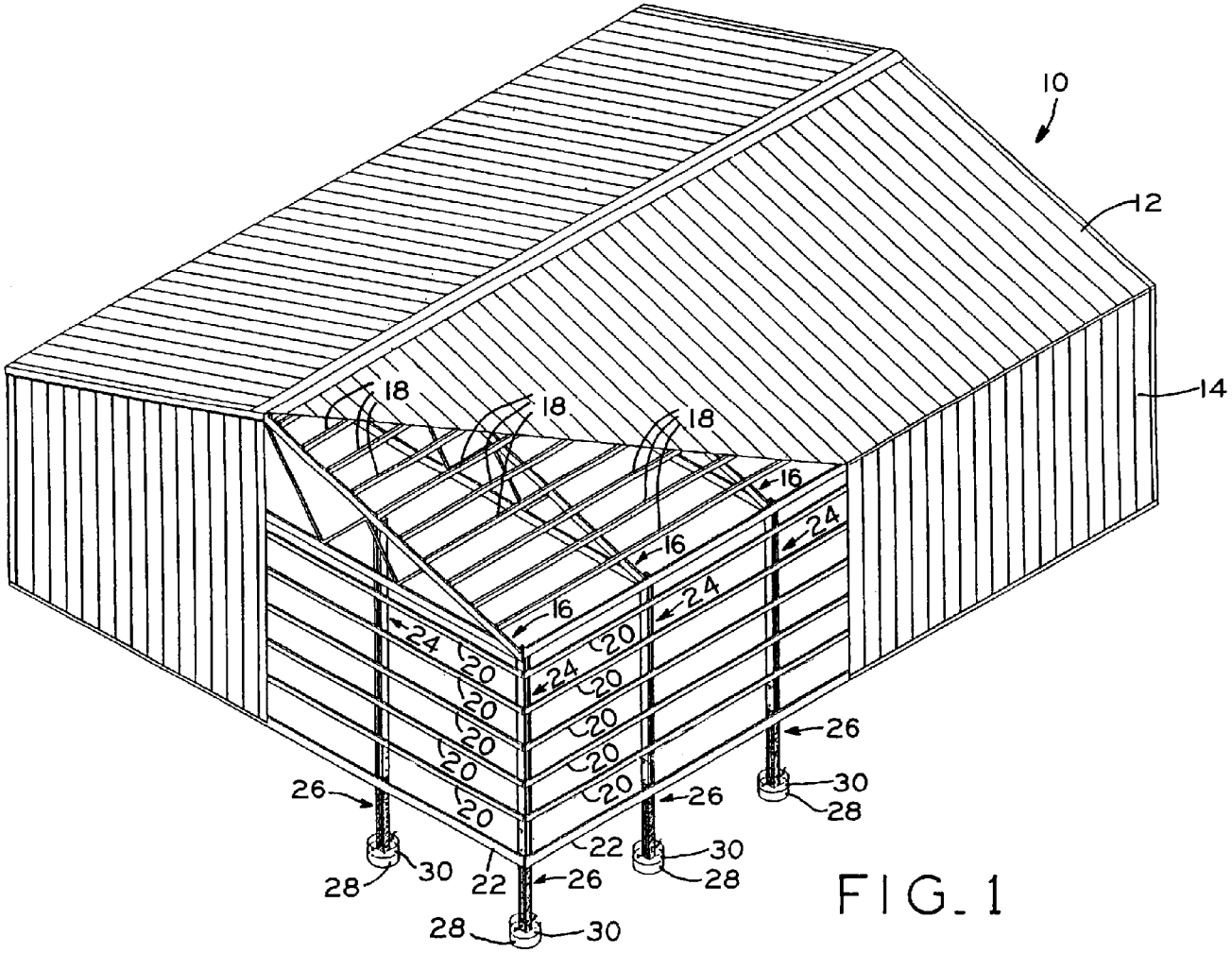
FIG. 1 is a cutaway perspective view of a post-frame building in accordance with the present disclosure.

Corresponding reference characters indicate corresponding parts throughout the several views. Although the drawings represent embodiments of the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION

The embodiments disclosed herein are not intended to be exhaustive or to limit the invention to the precise forms disclosed in the following detailed description. Rather, the embodiments are chosen and described so that others skilled in the art may utilize their teachings.

Figure 2:
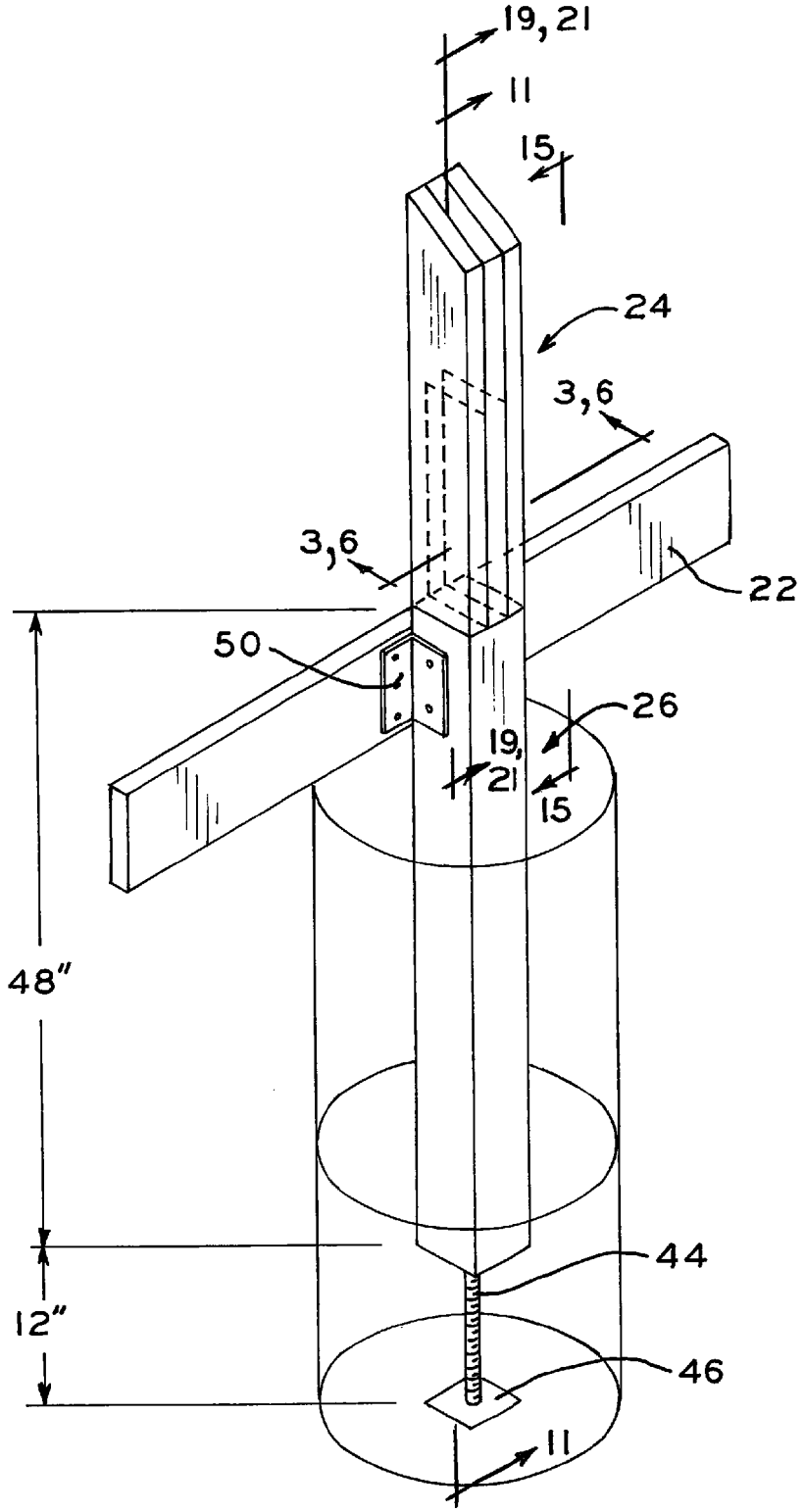
FIG. 2 is a partial perspective view of a column in accordance with the present disclosure secured to a skirt board.

A column constructed in accordance with the present disclosure is illustrated, e.g., in FIGS. 1 and 2. As illustrated in FIGS. 1 and 2, a column of the present disclosure has a two piece construction including foundation column 26 and wooden column 24. FIG. 2 is utilized to denote a generic foundation column 26. That is, it is used to illustrate the section lines for a number of different embodiments of foundation column 26.

Foundation column 26 is set in the earth, with a distal end abutting the bottom of a hole in the earth and a proximal end thereof protruding outwardly from the earth. Wooden column 24 is affixed to the proximal end of foundation column 26 and extends upwardly therefrom. As illustrated in FIG. 1, foundation columns 26 can be utilized as the foundation upon which post-frame building 10 is built and supported. The structure of post-frame building 10 is further described hereinbelow. In certain embodiments, foundation column 26 comprises a concrete foundation column molded or cast in situ, that is, the concrete is cured on site, e.g., in the earthen hole made to receive the column. In alternative embodiments, foundation column 26 comprises a precast concrete foundation column, i.e., a foundation column comprising a concrete column that is cured prior to being placed in its useful position to support a structure.

In various exemplary embodiments of the present disclosure, a reinforcing bar is positioned within a foundation column in a configuration in which the reinforcing bar will add tensile strength to every face of the foundation column. In practice, adding tensile strength to the face of a foundation column adjacent the building siding is of the greatest importance, as wind load on the side of a post-frame building can place a significant tensile force on the foundation column, tending to flex a proximal end of the foundation column toward the interior of the building in question. However, because such reinforcing bar is positioned to add tensile strength to every face of the foundation column, an installer need not be concerned with the proper rotational configuration of a foundation post of the present disclosure to ensure that reinforcing bar is positioned adjacent the face of the foundation column adjacent the building siding. Generally, a sufficient amount of reinforcing bar to withstand at least an 80 mph wind force is utilized in a foundation column of the present disclosure. Various exemplary embodiments of the present disclosure incorporate four reinforcing bars, with one bar in each quadrant of the body of the concrete foundation column.

In describing alternative exemplary embodiments of the present disclosure, similar elements are denoted with the same reference numeral with an alphabetic designator utilized when the elements are not part of an identical arrangement, e.g., when the elements are of differing dimensions and/or associated with different final constructs. For example two identical elements may have different alphabetic designators when they are associated with two different final constructs. At times, reference numerals without an alphabetic designator are utilized when generally referring to all embodiments of the present disclosure, even though reference may be made to particular figures for clarity.

Figure 6:
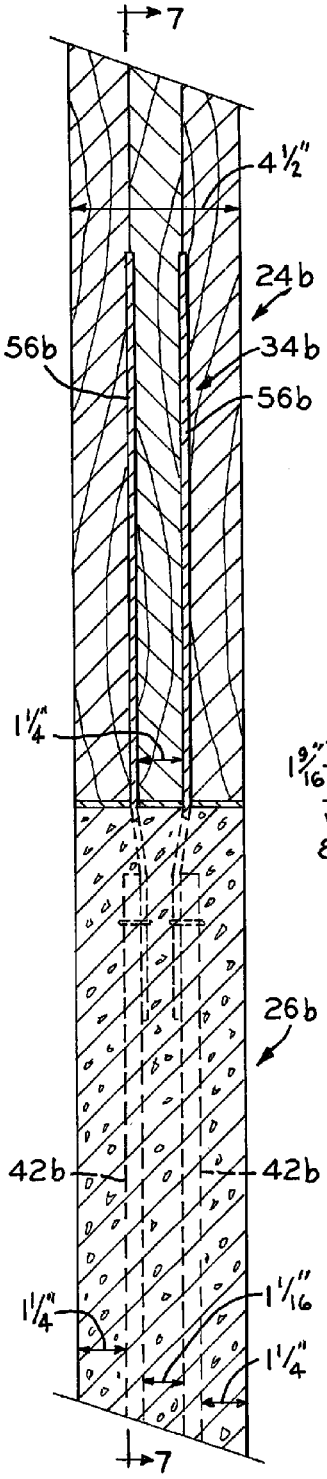
FIG. 6 is a sectional view of a further embodiment of the foundation column in accordance with the present disclosure taken along line 6-6 of FIG. 2.
Figure 7:
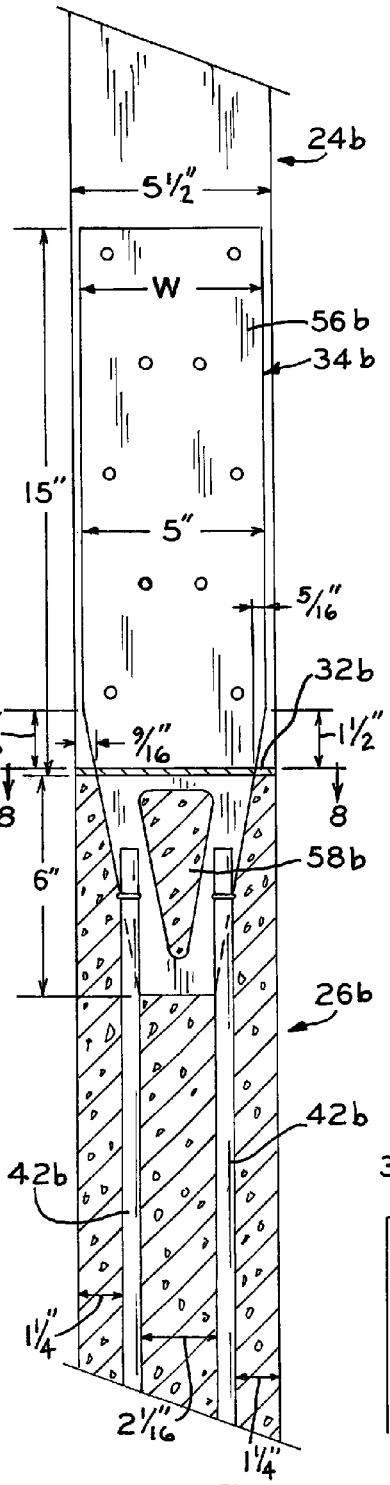
FIG. 7 is a sectional view of the column of FIG. 6 taken along line 7-7 of FIG. 6.
Figure 8:
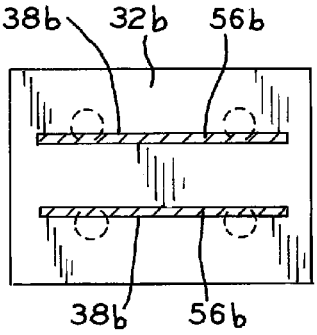
FIG. 8 is a partial sectional, plan view of the base plate and upstanding arms of an embodiment of the connecting structure of the present disclosure.
Figure 9:
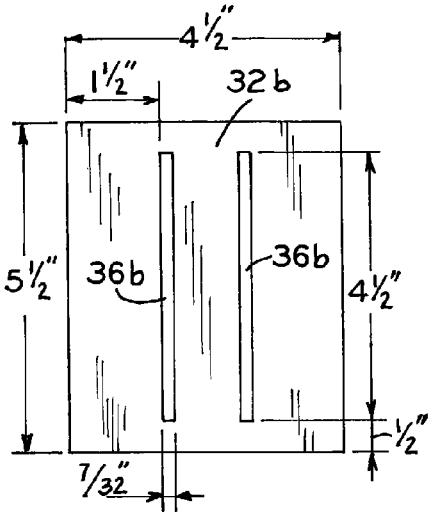
FIG. 9 is a plan view of the base plate illustrated in FIG. 8.
Figure 10:
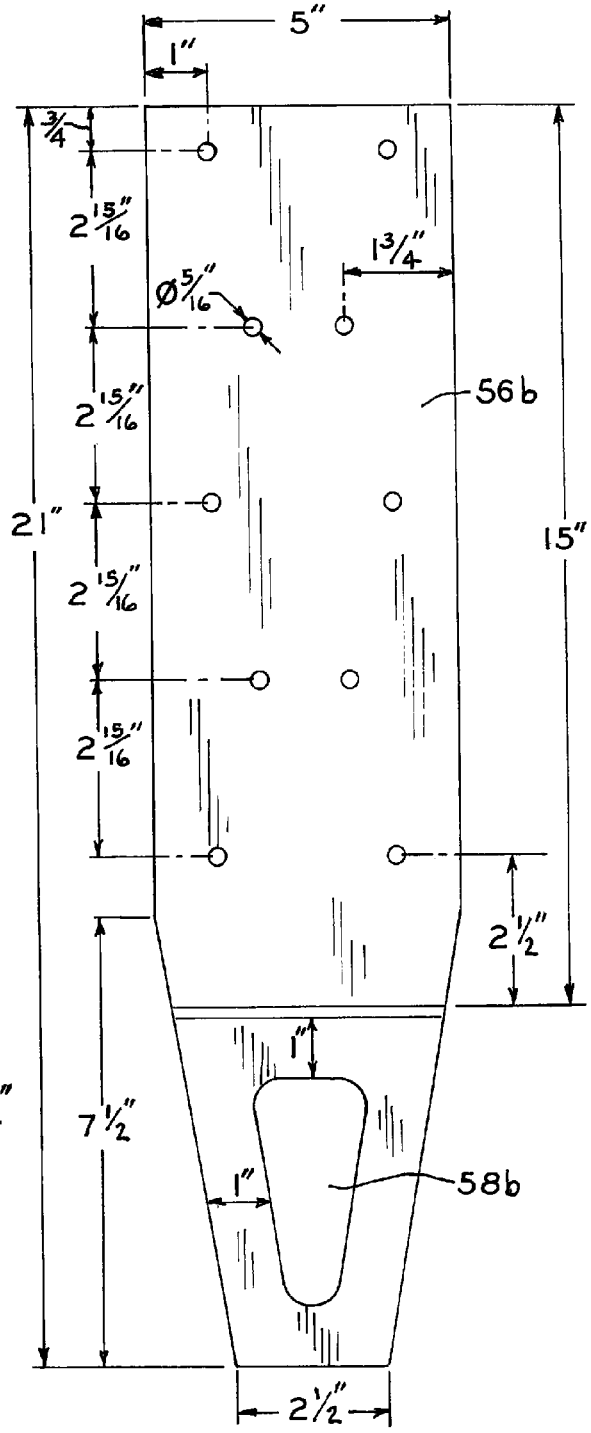
FIG. 10 is an elevational view of an upstanding arm of the connecting structure of FIG. 7.

Referring to FIGS. 6-12, an exemplary column constructed in accordance with the present disclosure is illustrated. Foundation column 26*b* comprises a precast concrete column including four reinforcing bars 42*b* embedded therein. As illustrated in FIGS. 6, 7, 11 and 12, reinforcing bars 42*b* are welded to an end of upstanding arms 56*b*. In the exemplary embodiment illustrated, two reinforcing bars 42*b* are welded to each upstanding arm 56*b*. FIG. 7 illustrates such a configuration with respect to one upstanding arm 56*b*. The second upstanding arm 56*b* will have a similar configuration with two reinforcing bars 42*b* welded thereto. Furthermore, a rebar tie is utilized to assemble reinforcing bars 42*b* and upstanding arms 56*b* as illustrated in FIGS. 6 and 7. Prior to welding reinforcing bars 42*b* to upstanding arms 56*b*, the distal end of upstanding arms 56*b* are each positioned through a slot 36*b* in base plate 32*b* (FIG. 9). Slots 36*b* are dimensioned such that travel of the distal end of each upstanding arm 56*b* therethrough is limited to a particular distance by the expanding width of the distal tapered profile of arms 56*b* (FIGS. 7 and 10). In the embodiment illustrated in FIGS. 6-8, that travel is 6 inches. In this position, base plate 32*b* can be tack welded to upstanding arms 56*b*. With upstanding arms 56*b*, base plate 32*b* and reinforcing bar 42*b* assembled as illustrated in FIGS. 6 and 7, this construct can be positioned within a mold into which a concrete mixture can be poured. In one exemplary embodiment, base plate 32*b* forms an end of the mold such that concrete will not flow past base plate 32*b* and base plate 32*b* will define the proximal most end of the molded concrete. After the concrete mixture is poured into the mold and sets, a complete precast foundation column 26*b* in accordance with an embodiment of the present disclosure is formed. Generally, foundation column 26*b* comprises a 4,000-8500 psi precast concrete column.

Figure 3:
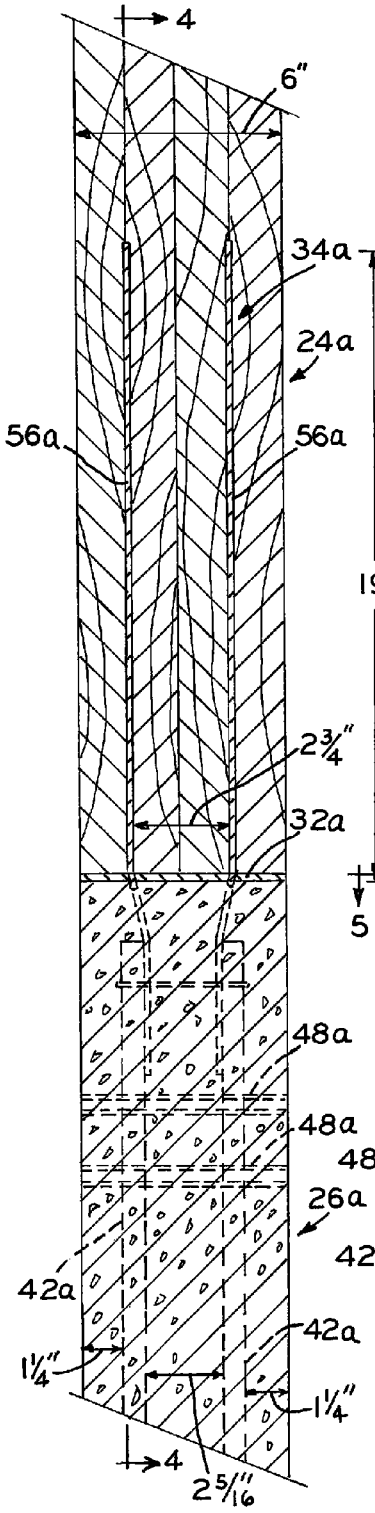
FIG. 3 is a sectional view of an embodiment of the foundation column in accordance with the present disclosure taken along line 3-3 of FIG. 2.
Figure 15:
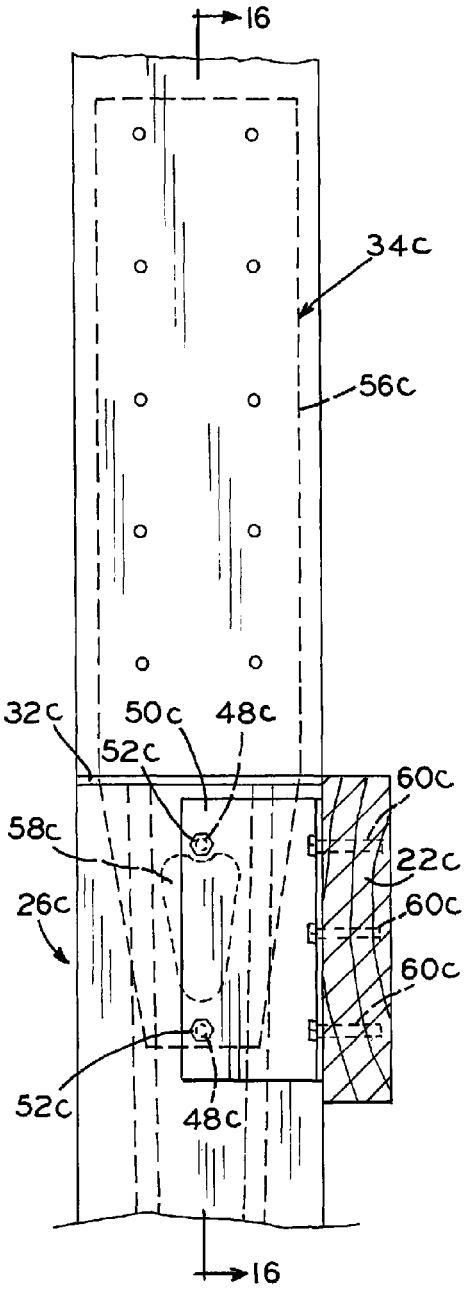
FIG. 15 is an elevational view of an alternative column assembly illustrating securement to a skirt board.
Figure 16:
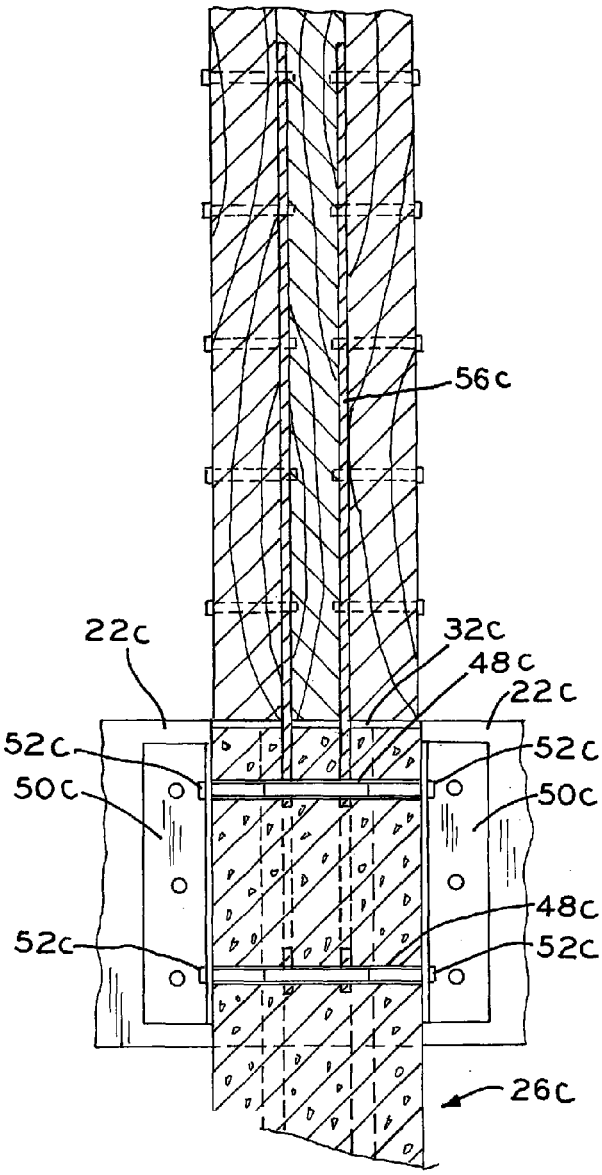
FIG. 16 is a sectional view of the arrangement of FIG. 15 taken along line 16-16.
Figure 17:
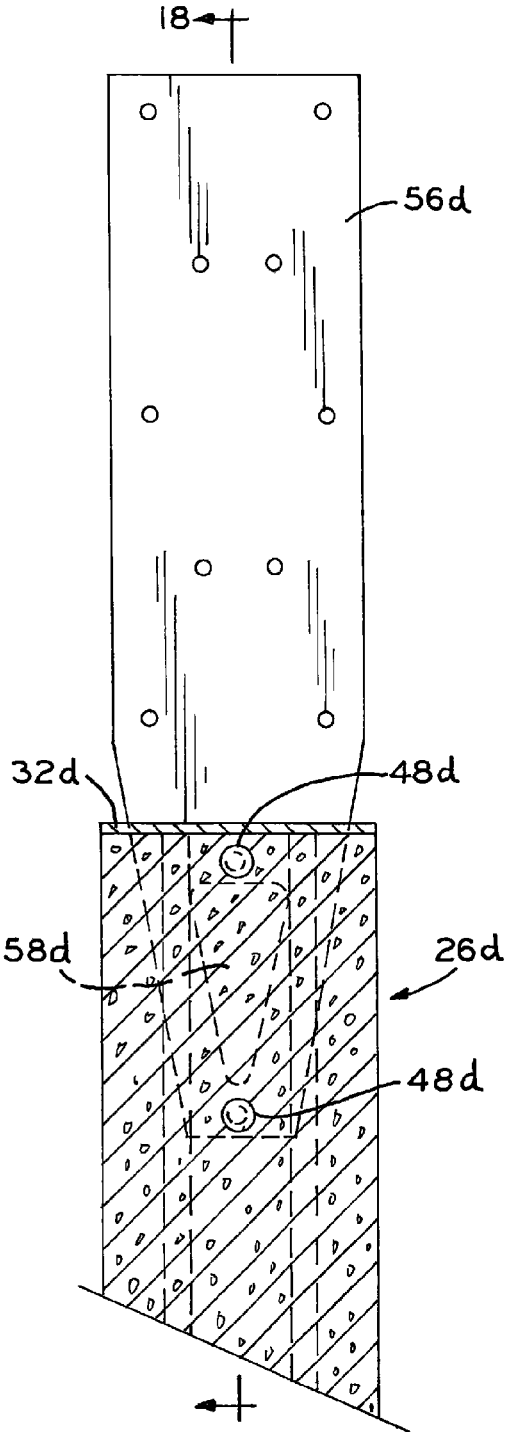
FIG. 17 is an elevational, partial sectional view of an alternative foundation column of the present disclosure.
Figure 18:
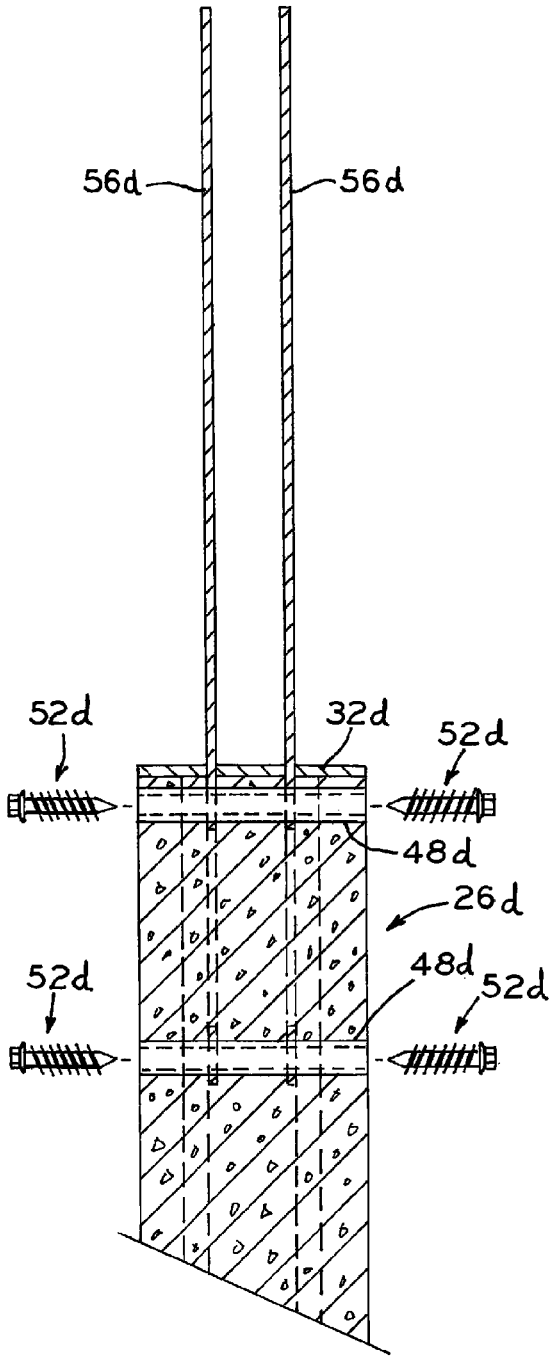
FIG. 18 is a sectional view of the foundation column of FIG. 17 taken along line 18-18.

Referring to FIGS. 4, 7, 10, 11, 15, 17, 19 and 21, upstanding arms 56*a*-56*f* each include a concrete flow hole 58*a*-58*f* positioned distal of base plate 32. The passage through upstanding arms 56*a*-56*f* formed by concrete flow hole 58*a*-58*f* will allow concrete to flow through upstanding arms 56*a*-56*f* so that the concrete body of foundation column 26*a*-26*f* interdigitates with arms 56*a*-56*f* and thereby locks upstanding arms 56*a*-56*f* securely in place. As illustrated in FIGS. 3 and 6, upstanding arms 56*a* and 56*b* incorporate a bend from their connection to reinforcing bars 42 to their proximal ends contained within wood columns 24. Alternative upstanding arms 56*c* and 56*d* illustrated in FIGS. 16 and 18 are substantially planar from their distal to their proximal ends.

As illustrated in FIGS. 6 and 7, upstanding arms 56*b* have a width W (FIG. 7) which is less than the width of the concrete base of foundation column 26*b*. In the exemplary embodiment, the width of the concrete base of foundation column 26*b* is 5½ inches, while width W of upstanding arms 56*b* is 5 inches. Further, referring to FIG. 6, upstanding arms 56*b* are positioned to extend from the concrete portion of foundation column 26*b* such that they are completely contained within depth d of the precast concrete base of foundation column 26*b*. In this way, the cross-sectional extent of both upstanding arms 56*b* together does not extend beyond an envelope defined by the cross-sectional extent of the precast concrete body of foundation column 26*b*. Advantageously, this allows utilization of a wooden column having a congruent or equal cross-section as the underlying precast concrete column body, without upstanding arms 56*b* disrupting the consistency of the exterior cross-section of the assembled column. In an exemplary embodiment, the distal end of the wood column directly abuts base plate 32*b* at the proximal end of foundation column 26*b* (as illustrated in FIGS. 6 and 7), such that the consistency of the cross-section of the assembled column results in an exterior profile that is substantially continuous across the foundational column/wood column junction.

Typically, wood columns 24 are secured to foundation columns 26 prior to foundation columns 26 being planted in an earthen hole. However, wood columns 24 may be secured to foundation columns 26 after planting foundation columns 26 in the ground.

Figure 4:
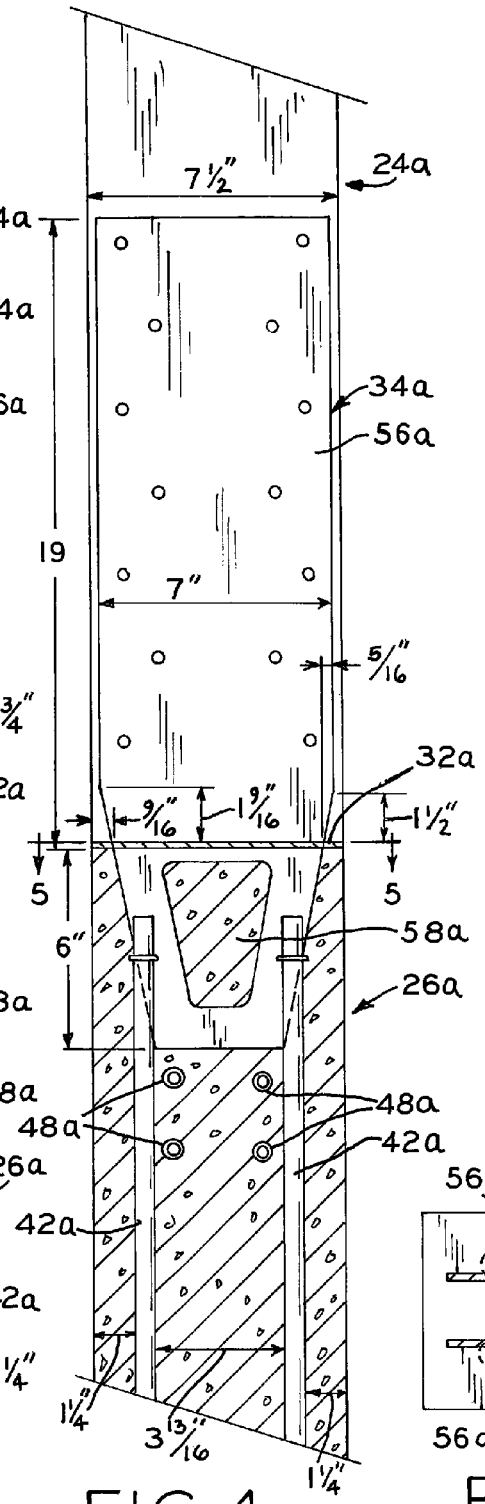
FIG. 4 is a sectional view of the column of FIG. 3 taken along line 4-4 of FIG. 3.

In embodiments of the present disclosure, wood columns 24, as illustrated, e.g., in FIGS. 2, 3 and 4 include a transverse cross-sectional extent that is substantially congruent to a transverse cross-sectional extent of foundation column 26 (i.e., contained within the profile of wood column 24). Stated another way, wood column 24 is designed to have a nominal width and depth that is substantially equal to the nominal width and depth of foundation column 26. In certain embodiments, these "substantially similar" dimensions may have minimal deviations of, e.g., less than ½ inch in either dimension. To allow upstanding arms 56 to be positioned within the envelope defined by the cross-sectional extent of the precast concrete column body of foundation column 26, wooden column 24 includes notches or slots 38 formed therein.

Figure 13:
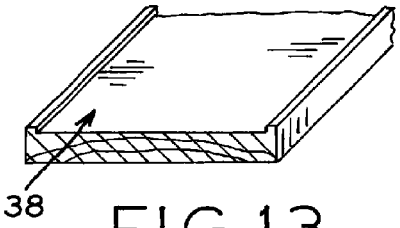
FIG. 13 is a partial, sectional, perspective view of a lamella used to form a laminated wood column for the present disclosure.
Figure 14:
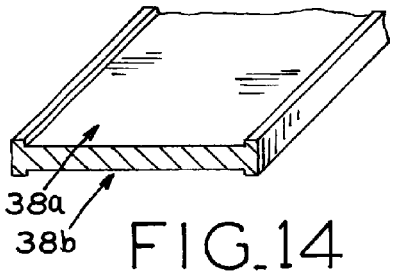
FIG. 14 is a partial, sectional, perspective view of an alternative embodiment lamella used to form a laminated wood column in accordance with the present disclosure.

Slots 38 have dimensions accommodating insertion of upstanding arms 56 so that no portion of upstanding arms 56 will be visible from an exterior of wooden column 24. Stated another way, slots 38 are defined by an opening formed through the distal end of wood column 24 that extends toward the proximal end of the wood column, but terminating short of the perimeter of wood column 24. That is to say, the entire periphery of each of slots 38 is contained within the perimeter of wood column 24, such that no part of the periphery of slots 38 crosses or otherwise intersects such perimeter. Referring to FIGS. 13 and 14, slots 38 can each be formed by forming a channel in a single lamella of a laminated column. The channel cooperates with an adjacent wood lamella to form slot 38. For the remainder of this detailed description, "slot" will be used to refer both the slot formed by positioning a wood lamella with a channel formed therein adjacent to another wood lamella to define a slot and the channel itself. Because wood column 24 defines a transverse cross-sectional extent that is substantially congruent to the transverse cross-sectional extent of foundation column 26, with upstanding arms 56 positioned in slot 38 of wood column 24, wood column 24 and foundation column 26 present a substantially continuous exterior profile.

In the exemplary embodiment illustrated in FIGS. 6 and 7, a three ply laminated column is utilized. In this embodiment, each outer ply of the three ply column may include a slot (38) sized to accommodate an upstanding arm 56. Alternatively, an interior lamella such as the one illustrated in FIG. 14 and including slots 38*a* and 38*b* may be utilized to provide both slots. Slots 38 may be formed in one or more lamellae of a laminated wood column by a planer.

Figure 5:
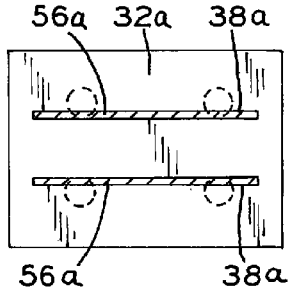
FIG. 5 is a plan view of the base plate and upstanding arms of a connecting structure of the present disclosure.

In the embodiment illustrated in FIGS. 3-5, a four ply laminated wooden column 24*a* is utilized. In this embodiment, slots 38*a* will each be formed in a one face of a distinct lamella of the laminated column. With upstanding arms 56*a* positioned in slots 38*a*, fasteners such as screws may be secured through wooden column 24*a* and the apertures formed in upstanding arms 56*a* to secure wooden columns 24*a* to foundation column 26*a*. To aid in proper location of the apertures by an installer, a template imprinted with such aperture locations may be overlaid onto wooden columns 24*a*. In one exemplary embodiment, wooden columns 24*a* are pre-marked with the hole locations to obviate the need for a separate template. Fasteners that are sufficiently long to engage a pair of upstanding arms 56*a* may be utilized. In such a construct, the fasteners will be said to be in a double shear load condition, owing to the fact that the fastener will have screw purchase in two upstanding arms 56*a*.

Figure 11:
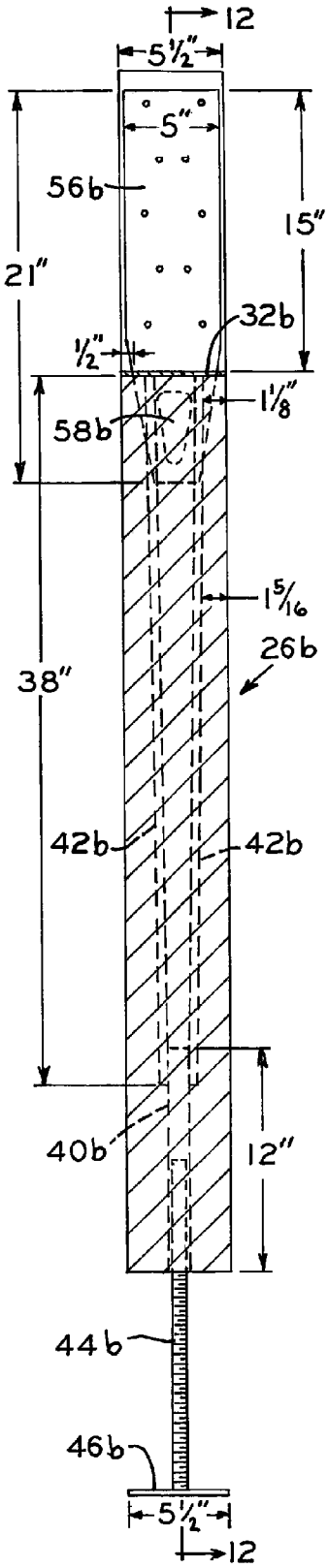
FIG. 11 is a sectional view of another embodiment of the foundation column in accordance with the present disclosure taken along line 11-11 of FIG. 2.
Figure 12:
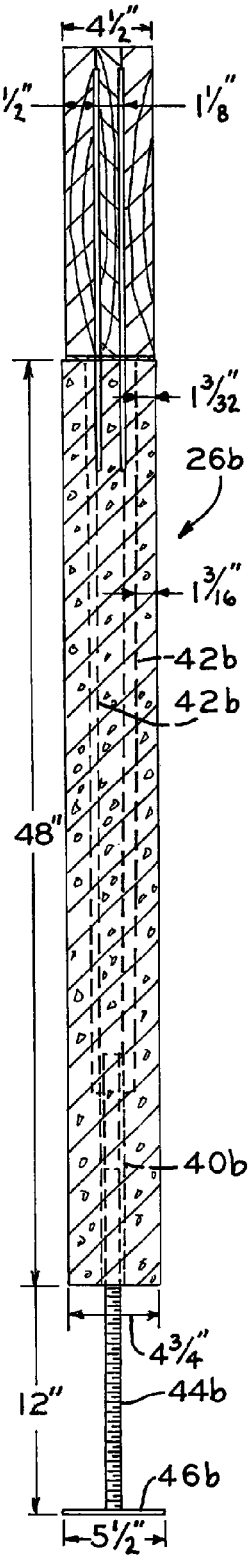
FIG. 12 is a sectional view of the column of FIG. 11 taken along line 12-12 of FIG. 11.

FIGS. 11 and 12 illustrate an exemplary embodiment in which tube 40*b* is secured to the distal ends of reinforcing bars 42*b*. In one exemplary embodiment, four reinforcing bars 42*b* will taper inwardly in a proximal to distal direction until meeting at tube 40*b*. Reinforcing bars 42*b* are welded to tube 40*b* so that tube 40*b* is fixedly secured thereto. Tube 40*b* (along with reinforcing bar 42*b*, base plate 32*b* and upstanding arms 56*b*) is, in one exemplary embodiment, formed of steel. For example, upstanding arms 56*b*, base plate 32*b*, reinforcing bar 42*b* and tube 40*b* may be formed of A36 steel. As illustrated in FIGS. 11 and 12, tube 40*b* does not extend the full length of the precast concrete base of foundation column 26*b*. In the embodiment illustrated in FIG. 11, tube 40*b* extends proximally into the precast concrete body of foundation column 26*b* 12 inches. In this embodiment, the precast concrete body of foundation column 26*b* has a total length of 48 inches. In embodiments utilizing tube 40*b*, tube 40*b* is positioned in the mold into which concrete is poured to form the precast concrete body of foundation column 26*b*. Prior to pouring concrete into the mold, the proximal end of tube 40*b* may be capped so that concrete will not flow into tube 40*b*. Similarly, distal end of tube 40*b* may be capped as a precaution to prevent concrete from flowing into tube 40*b*.

Tube 40*b* includes a longitudinal aperture into which jack screw 44*b* may be positioned. In embodiments of the present disclosure, the internal longitudinal aperture of tube 40*b* is at least partially threaded so that jack screw 44*b* (which includes external threads) may be threaded into and out of tube 40*b* so that jack screw 44*b* extends a variable length outwardly from the precast concrete body of foundation column 26*b*. In one exemplary embodiment, a nut is welded to a distal end of tube 40*b*, with the threaded interior of the nut forming the threaded portion of the interior wall of tube 40*b*. In alternative embodiments, tube 40*b* comprises a steel pipe having internal threads formed therein. As illustrated in FIGS. 11 and 12, base 46*b* may be secured to a distal end of jack screw 44*b*. Base 46*b* is generally a polygonal plate on which foundation column 26*b* can be supported. In one exemplary embodiment, base 46*b* comprises a square plate. In alternative embodiments, a rectangular plate may be utilized. Generally, forming base 46*b* as a polygonal plate provides for resistance to rotation of base 46*b* when it is positioned atop the earthen base of a post hole.

In use, base 46*b* can be positioned on the floor of an earthen hole and the precast concrete column body can thereafter be rotated to adjust the height of foundation column 26. In certain embodiments, the floor of the earthen hole will be defined by a concrete pad 28 (FIG. 1) positioned therein. During rotation of the precast concrete body, base 46*b* engages the floor of the earthen hole to resist rotation of base 46*b*. As the precast concrete body of foundation column 26*b* rotates relative to base 46*b*, the threaded engagement of jack screw 44*b* with threaded tube 40*b* causes the precast concrete body to either raise or lower relative to base 46*b*, depending on the direction of rotation. Advantageously, jack screw 44*b* may be utilized to adjust the height of foundation column 26*b* to account for post holes of inconsistent depth. In this way, providing a level foundation for post-frame building 10*b* is facilitated.

When utilizing foundation column 26*b* illustrated in FIGS. 11 and 12, base 46*b* can be positioned atop the earthen base of the post hole into which foundation column 26*b* will rest and a concrete pad may be poured in place to further anchor foundation column 26*b* in the earthen post hole in which it is positioned. A precast concrete pad placed in the bottom of the post hole is not needed. Because base 46*b* is supported by underlying ground and not the poured in place cement pad, further construction of post-frame building 10*b* may commence prior to setting of the poured in place concrete pad. This poured in place concrete pad provides resistance to uplift of foundation column 26*b* once backfill is utilized to fill in the post hole into which foundation column 26*b* is positioned.

Referring to FIGS. 3 and 4, anchor tubes 48*a* may be cast in place in the precast concrete body of foundation column 26*a*. In exemplary embodiments, anchor tubes 48*a* are formed of crosslinked polyethylene (PEX) material. In alternative embodiments, aluminum, steel and/or polytetrafluoroethylene (TEFLON) tubing may be utilized. While illustrated with reference to foundation column 26*a*, anchor tubes 48*a* may be utilized in a similar fashion with any embodiment of the present disclosure. Moreover, it is contemplated that any and all features described and illustrated with reference to a single embodiment may be incorporated into all other embodiments of the present disclosure, as required or desired for a particular application.

Prior to molding the precast concrete body of foundation column 26, anchor tubes 48 may be held in place by securement to reinforcing bar 42. Further, the concrete mold may include features designed to hold anchor tubes 48 in place during the setting of the concrete utilized to form the precast concrete body of foundation column 26. Additionally, as illustrated in FIGS. 15 and 17, upstanding arms 56*c*, 56*d* may include an aperture through which anchor tubes 48*c*, 48*d* can be positioned and held in place during casting of foundation column 26*c*, 26*d*. Advantageously, anchor tubes 48 provide an opening on opposing sides of foundation column 26 so that a lag bolt or other fastener may be positioned therethrough to secure, e.g., angle bracket 50 to foundation column 26 (FIG. 2), thus providing for quick and easy securement of skirt board 22 to foundation column 26. To secure skirt board 22 to angle bracket 50, additional fasteners such as lag screws may be positioned through angle bracket 50 and skirt board 22.

FIGS. 15 and 16 further illustrate securement of angle bracket 50*c* to foundation column 26*c*. As illustrated, fasteners 52*c* are positioned through apertures and angle bracket 50*c*, such that a head of fastener 52*c* abuts angle bracket 50*c* and threaded shank of fastener 52*c* is threadably secured in anchor tube 48*c*. Additional fasteners 60*c* (FIG. 15) may be utilized to secure angle bracket 50*c* to skirt board 22*c*.

In an alternative embodiment of the present disclosure, anchor tubes 48 are replaced with a solid high density polyethylene insert in the form of a plug into which a variety of fasteners including, e.g., a lag screw may be firmly secured. In these embodiments, the inserts may include notched sides so that the concrete forming the precast concrete body of foundation column 26 can attain good adhesion. Materials other than high density polyethylene may also be utilized to form such inserts, including the materials mentioned above with respect to the anchor tubes. Exemplary materials include polyvinyl chloride (PVC). Inserts of this form of the present disclosure may be predrilled with pilot holes to facilitate insertion of, e.g., a lag screw therein. Generally, the transverse anchor receivers such as the tubes and inserts described above can be formed of plastics such as crosslinked polyethylene, high density polyethylene and polyvinyl chloride into which good screw purchase can be achieved. Any of the materials mentioned in this specification for forming any of the anchor embodiments may be used to form any of the other anchor embodiments. The material of any of the anchor tube, plugs, etc. embedded into the concrete column body will be formed of a material having increased resistance to screw pull out relative to the remainder of the concrete column body. Because anchor tubes 48 extend fully through the entire column, fastener on opposite sides of the column that engage the same anchor tube will be properly aligned, without additional effort on the part of the installer to effect such alignment.

Figure 19:
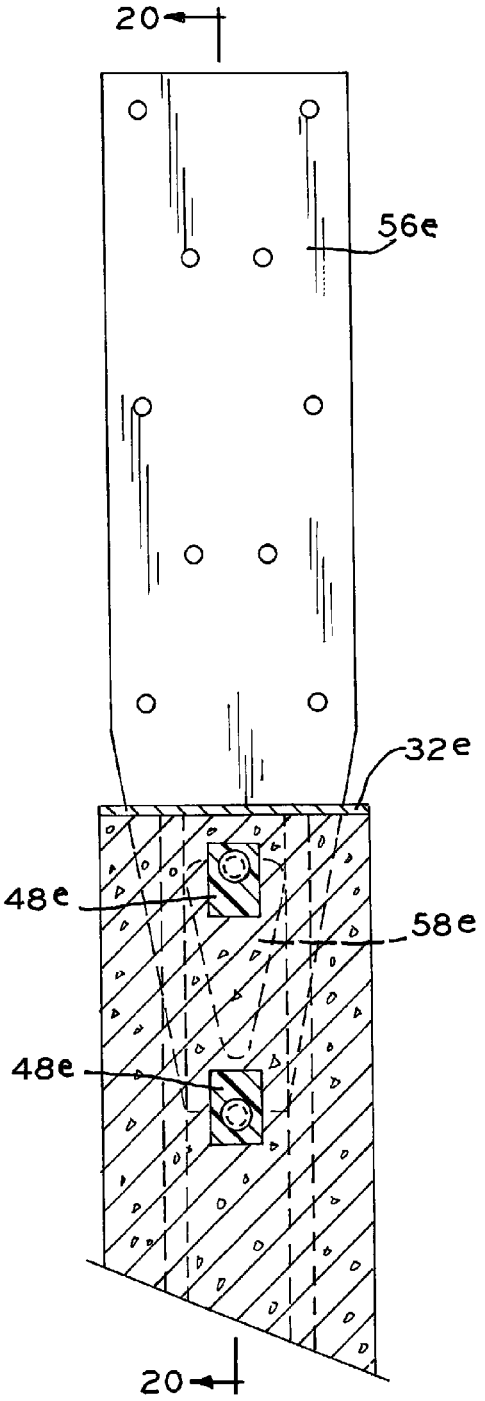
FIG. 19 is an elevational, partial sectional view of another alternative foundation column of the present disclosure.
Figure 20:
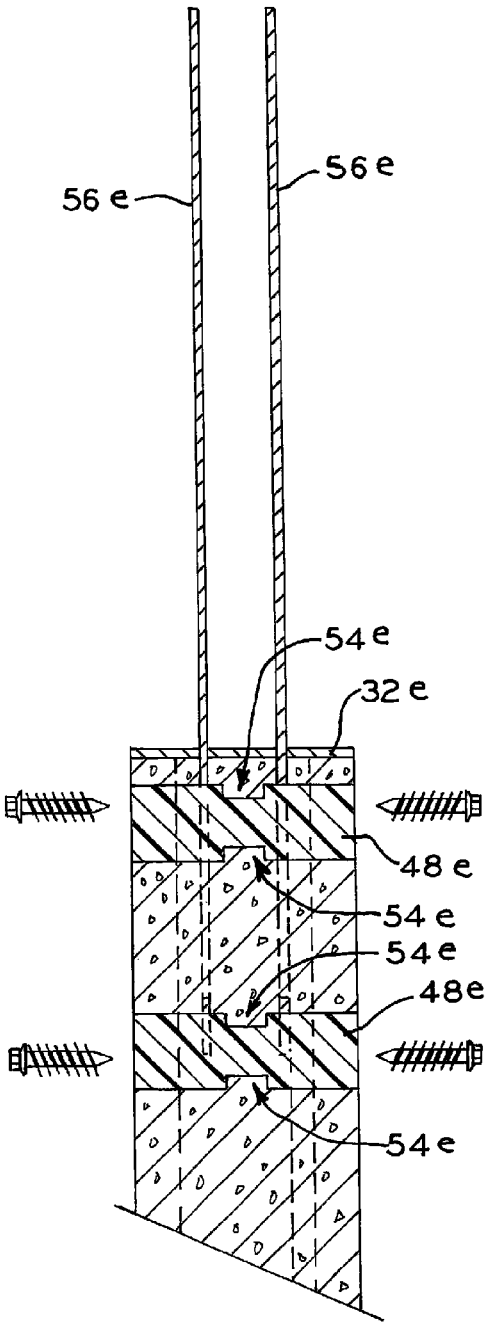
FIG. 20 is a sectional view of the foundation column of FIG. 19 taken along line 20-20.

Anchor tubes 48 of the various embodiments of the present disclosure may have an inner tube diameter that is 54% to 76% of the outer tube diameter. Fasteners 52 (FIG. 18) utilized to threadedly engage anchor tubes 48 can have a root diameter of 86% to 98% of the inner diameter of the associated anchor tube 48. The thread of fasteners 52 may define an outer screw diameter of 82% to 105% of the outer diameter of the associated anchor tube 48. The outer diameter of the tube may incorporate a ridge, e.g., a spiral ridge extending therefrom to increase the pull-out resistance of the anchor tube 48 relative to the concrete foundation column. For example, FIGS. 19 and 20 illustrate anchor plugs 48*e* extending through cutouts in upstanding arms 56*e*. Anchor plugs 48*e* include cutouts 54*e* forming pull-out resistant ridges on either side thereof. Similar ridges may be formed in the anchor "tube" embodiments described herein.

Figure 21:
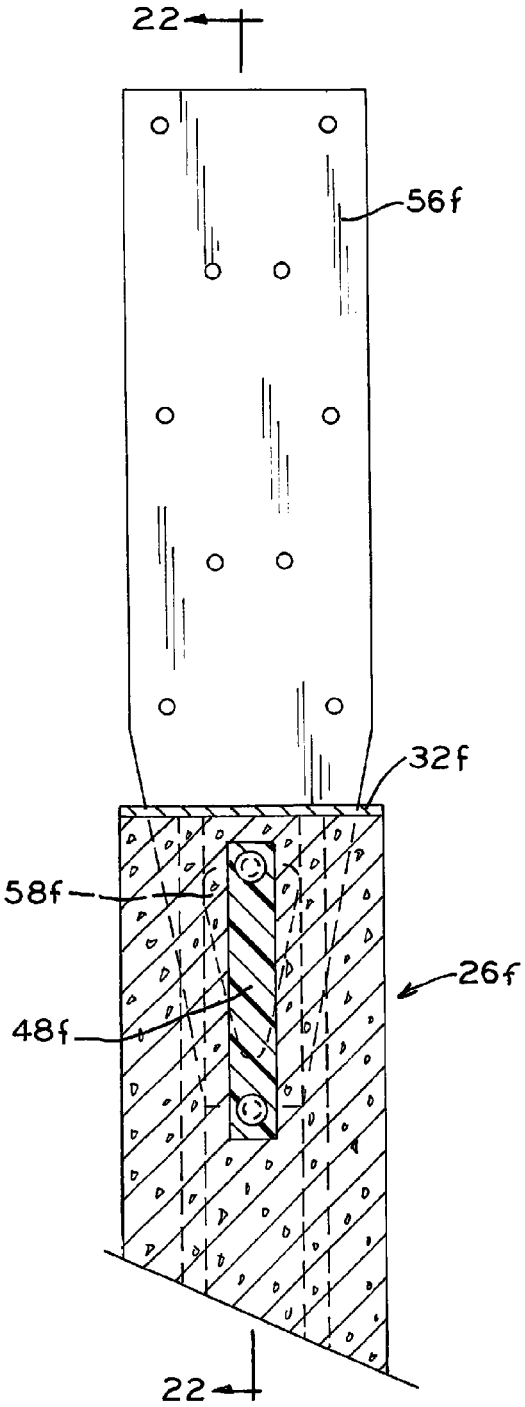
FIG. 21 is an elevational, partial sectional view of a further alternative foundation column of the present disclosure.
Figure 22:
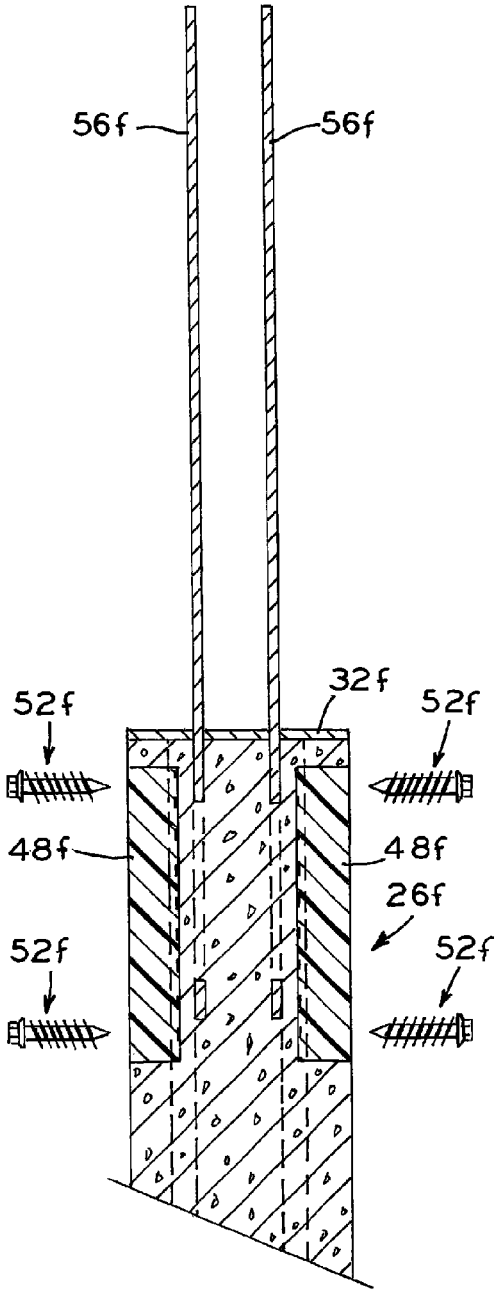
FIG. 22 is a sectional view of the foundation column of FIG. 21 taken along line 21-21.

FIGS. 21 and 22 illustrate an alternative embodiment in which anchor plugs 48*f* are not positioned transverse to foundation column 26*f*, but rather are positioned generally aligned with the longitudinal axis of upstanding arms 56*f* (and foundation column 26*f*). Anchor plugs 48*f* are embedded in foundation column 26*f* and present a face exposed from the exterior of foundation column 26*f*. Plugs 48*f* provide material into which fasteners 52*f* can be secured without requiring the use of a masonry bit to drill the concrete foundation column.

To construct post-frame building 10 illustrated in FIG. 1, a series of holes in the earth are made about the intended perimeter of building 10. Optionally, concrete pads 28 are first positioned in each hole prior to positioning foundation columns 26 therein. In embodiments utilizing jack screw 44 and base 46, precast concrete pads 28 are unnecessary. Concrete pads 28 are positioned in the distal most region of the post holes and foundation columns 26 are positioned within the holes and placed atop concrete pads 28. Alternatively, base 46 is positioned adjacent the bottom of the post hole. Foundation columns 26 are generally positioned with upstanding arms 56 of connector 34 substantially perpendicular to a plane in which siding member 14 will be positioned. With foundation columns 26 substantially vertically positioned, concrete collars 30 (FIG. 1) are poured, if desired. The holes are thereafter back-filled to maintain the vertical orientation of foundation columns 26. Columns 24 are affixed to connector 34 as described hereinabove and skirt board 22, girts 20, trusses 16, purlins 18, siding member 14, and roofing member 12 are assembled to complete the construction of building 10 as shown in FIG. 1. Fastening mechanisms including, e.g., screws and nails may be utilized to affix various wooden members of post-frame building 10 as well as siding member 14 and roofing member 12.

While the present disclosure has been described as having exemplary designs, the present disclosure can be further modified within the spirit and scope of this disclosure. This application is therefore intended to cover any variations, uses or adaptations of the disclosure using its general principles. Further, this application is intended to cover such departures from the present disclosure as come within known or customary practice in the art to which this disclosure pertains.

What is claimed is:

1. A foundation column for providing support to a structure, the column comprising:

a concrete column body having a proximal cross-sectional extent defining a cross-sectional envelope;

an upstanding arm secured to and extending from a proximal end of said concrete column body, said upstanding arm having a cross-sectional extent along its length that never extends beyond the cross-sectional envelope defined by the proximal cross-sectional extent of the concrete column body;

a wood column having a distal end, a proximal end and a perimeter along a wood column length between the distal end and the proximal end of the wood column, said wood column including a slot defined by an opening formed through the distal end of the wood column and extending toward the proximal end of the wood column, said slot terminating short of said perimeter, whereby access to said slot is permitted only through the distal end of the wood column, said slot sized to receive said upstanding arm extending from said proximal end of said concrete column body, whereby, with said upstanding arm received in said slot, a fastener may be positioned to engage said wood column and said upstanding arm to secure said wood column to said concrete column body; and an embedded anchor receiver embedded in said proximal end of the concrete column body, said embedded anchor receiver presenting an exposed face from said concrete column body.

2. The foundation column of claim 1, wherein a transverse cross-sectional extent of said concrete column body is substantially congruent to a transverse cross-sectional extent of said wood column, whereby, with said upstanding arm positioned in said slot of said wood column and said wood column positioned atop and aligned with said concrete column, said concrete column and said wood column present a substantially continuous exterior profile.

3. The foundation column of claim 1, wherein said wood column comprises a laminated wood column formed of at least two wood lamellae comprising a first wood lamella and a second wood lamella, said first wood lamella having a first abutment surface abutting a second abutment surface of said second wood lamella to form said laminated wood column, said first abutment surface of said first wood lamella having a channel formed therein, said channel and said second abutment surface of said second wood lamella cooperating to form said slot.

4. The foundation column of claim 1, wherein said wood column comprises a laminated wood column formed of at least three wood lamellae comprising a first wood lamella, a second wood lamella, and a third wood lamella, said first wood lamella having a first abutment surface, said second wood lamella having a pair of opposing second abutment surfaces, said third wood lamella having a third abutment surface, said first abutment surface of said first wood lamella abutting one of said pair of second abutment surfaces of said second wood lamella, said third abutment surface of said third wood lamella abutting the other of said pair of second abutment surfaces of said second wood lamella, said pair of opposing second abutment surfaces of said second wood lamella both having a channel formed therein, one of said channels cooperating with said first abutment surface of said first wood lamella to form said slot, the other of said channels cooperating with said third abutment surface of said third wood lamella to form a second slot, said second slot defined by a second opening formed through the distal end of the wood column and extending toward the proximal end of the wood column, said second slot terminating short of said perimeter of said wood column, whereby access to said second slot is permitted only through the distal end of the wood column, said foundation column further comprising:

a second upstanding arm secured to and extending from a proximal end of said concrete column body, said second upstanding arm having a cross-sectional extent along its length that never extends beyond the cross-sectional envelope defined by the proximal cross-sectional extent of the concrete column body, said second slot sized to receive said second upstanding arm extending from said proximal end of said concrete column body, whereby, with said second upstanding arm received in said second slot, a second fastener may be positioned to engage said wood column and said second upstanding arm to secure said wood column to said concrete column body.

5. The foundation column of claim 1, further comprising:

a base having a side;

a threaded extension extending from said base, said concrete column body having a distal end opposite the proximal end, the distal end defining an opening, a tube secured relative to said concrete column, said tube defining an internal threaded bore aligned with said opening in said distal end of said concrete column body, said threaded extension threadedly engaging said internal threaded bore, whereby, with said base engaging a floor of an earthen hole and said threaded extension threadedly engaged in said internal threaded bore, said side of said base resists rotation so that said concrete column body can be rotated to adjust the height of the concrete column body relative to the floor of the earthen hole.

6. The foundation column of claim 5, wherein said concrete column body has a height measured from said proximal end to said distal end of said concrete column body, said internal threaded bore extending from said distal end of said concrete column body toward said proximal end of said concrete column body a distance less than said height of said concrete column body, whereby said internal threaded bore does not extend through said proximal end of said concrete column body.

7. The foundation column of claim 1, wherein said anchor receiver extends transversely through said proximal end of said concrete column body.

8. The foundation column of claim 7, wherein said transverse anchor receiver comprises a tube formed of plastic.

9. The foundation column of claim 7, wherein said transverse anchor receiver comprises a transverse plug formed of plastic.

10. The foundation column of claim 5, wherein said anchor receiver extends transversely through said proximal end of said concrete column body.

11. The foundation column of claim 10, wherein said transverse anchor receiver comprises a tube formed of plastic.

12. The foundation column of claim 10, wherein said transverse anchor receiver comprises a transverse plug formed of plastic.

13. The foundation column of claim 1, wherein said concrete column body of said foundation column comprises a precast concrete column body.

14. A foundation column for providing support to a structure, the column comprising:

a precast concrete column body having a proximal end and a distal end, the distal end defining an opening providing access to an internal threaded bore extending from said opening in said distal end toward said proximal end;

a base comprising a polygonal plate having an exposed side; and a threaded extension extending from said base and threadedly engaging said internal threaded bore in said precast concrete column body, whereby, with said base engaging a floor of an earthen hole and said threaded extension threadedly engaged in said internal threaded bore of said precast concrete column body, said exposed side of said base resists rotation so that said precast concrete column is rotatable to adjust the height of the precast concrete column body relative to the floor of the earthen hole, wherein said precast concrete column body includes a proximal end and a distal end, the proximal end of the precast concrete column body having an embedded anchor receiver embedded therein, said embedded anchor receiver presenting an exposed face facing outwardly from said precast concrete column body.

15. The foundation column of claim 14, wherein said precast concrete column body has a height measured from said proximal end to said distal end of said precast concrete column body, said internal threaded bore extending from said distal end of said precast concrete column body toward said proximal end of said precast concrete column body a distance less than said height of said precast concrete column body, whereby said internal threaded bore does not extend through said proximal end of said precast concrete column body.

16. The foundation column of claim 14, wherein said internal threaded bore comprises a steel pipe having internal threading.

17. A foundation column for providing support to a structure, the column comprising:

a precast concrete column body having a proximal end and a distal end, the distal end defining an opening providing access to an internal threaded bore extending from said opening in said distal end toward said proximal end;

a base comprising a polygonal plate having an exposed side; and a threaded extension extending from said base and threadedly engaging said internal threaded bore in said precast concrete column body, whereby, with said base engaging a floor of an earthen hole and said threaded extension threadedly engaged in said internal threaded bore of said precast concrete column body, said exposed side of said base resists rotation so that said precast concrete column is rotatable to adjust the height of the precast concrete column body relative to the floor of the earthen hole, wherein said precast concrete column body includes a proximal end and a distal end, the proximal end of the precast concrete column body having a transverse anchor receiver extending transversely therethrough.

18. The foundation column of claim 17, wherein said transverse anchor receiver comprises a tube formed of plastic.

19. The foundation column of claim 17, wherein said transverse anchor receiver comprises a transverse plug formed of plastic.

20. A method of anchoring a structure in the earth, comprising:

forming an earthen hole having a floor;

positioning a foundation column in the earthen hole, the foundation column comprising:

a precast concrete column body having a proximal end and a distal end, the distal end defining an opening, a tube defining an internal threaded bore aligned with said opening in said distal end of said precast concrete column body;

a base comprising a polygonal plate having an exposed side;

a threaded extension extending from said base and threadedly engaging said internal threaded bore in said precast concrete body; and a transverse anchor receiver extending transversely through the proximal and of said precast concrete column body;

said step of positing the foundation column in the earthen hole comprises the step of engaging the base with the floor of the earthen hole; and rotating said precast concrete column body relative to the floor of the earthen hole after said step of engaging the base with the floor of the earthen hole to adjust the height of the precast concrete column body relative to the floor of the earthen hole.

21. The method of claim 20, wherein the precast concrete column body defines a proximal cross-sectional extent defining a cross-sectional envelope, and wherein the precast concrete column body further comprises an upstanding arm secured to and extending from a proximal end of said precast concrete column body, said upstanding arm having a cross-sectional extent along its length that never extends beyond the cross-sectional envelope defined by the proximal cross-sectional extent of the precast concrete column body, said method further comprising:

securing a wood column to the foundation column, the wood column having a distal end, a proximal end and a perimeter along a wood column length between the distal end and the proximal end of the wood column, said wood column including a slot defined by an opening formed through the distal end of the wood column and extending toward the proximal end of the wood column, said slot terminating short of said perimeter, whereby access to said slot is permitted only through the distal end of the wood column, said slot sized to receive said upstanding arm extending from said proximal end of said precast concrete column body;

positioning said upstanding arm in said slot; and securing a fastener through said wood column to engage said wood column and said upstanding arm to secure said wood column to said precast concrete body.

22. The method of claim 21, wherein said step of securing a wood column to the foundation column comprises the step of aligning the wood column with the foundation column, wherein a transverse cross-sectional extent of the precast concrete column body is substantially congruent to a transverse cross-sectional extent of the wood column, said aligning step creating a continuous column in which the precast concrete column body and the wood column present a substantially continuous exterior profile.

23. The method of claim 20, wherein the transverse anchor receiver comprises an embedded anchor receiver, said embedded anchor receiver presenting an exposed face from said precast concrete column body, said step of positioning the foundation column in the earthen hole comprises the step of positioning the distal end of the precast concrete column body into the earthen hole so that the proximal end of the foundation column extends outwardly from the earthen hole and the embedded anchor receiver is accessible above grade, the method further comprising the step of:

securing a skirt board positioned at least partially above grade and transverse to the precast concrete column body to the precast concrete column body by securing a fastener to the embedded anchor receiver of the precast concrete column body and the skirt board.

24. The method of claim 20, wherein said step of positioning the foundation column in the earthen hole comprises the step of positioning the distal end of the precast concrete column body into the earthen hole so that the proximal end of the foundation column extends outwardly from the earthen hole and the transverse anchor receiver is accessible above grade, the method further comprising the step of:

securing a skirt board positioned at least partially above grade and transverse to the precast concrete column body to the precast concrete column body by securing a fastener to the transverse anchor receiver of the precast concrete column body and the skirt board.

25. The method of claim 21, wherein said step of positioning the foundation column in the earthen hole comprises the step of positioning the distal end of the precast concrete column body into the earthen hole so that the proximal end of the foundation column extends outwardly from the earthen hole and the transverse anchor receiver is accessible above grade, the method further comprising the step of:

securing a skirt board positioned at least partially above grade and transverse to the precast concrete column body to the precast concrete column body by securing a fastener to said transverse anchor receiver of the precast concrete column body and the skirt board.

* * * * *